US012258235B1

(12) United States Patent
Haase

(10) Patent No.: US 12,258,235 B1
(45) Date of Patent: Mar. 25, 2025

(54) SUPPLY ROLL STAND WITH PAYOUT AND ROLL CHANGING

(71) Applicant: BROWN LLC, Beaverton, MI (US)

(72) Inventor: Peter Haase, Beaverton, MI (US)

(73) Assignee: BROWN LLC, Beaverton, MI (US)

( * ) Notice: Subject to any disclaimer, the term of this patent is extended or adjusted under 35 U.S.C. 154(b) by 0 days.

(21) Appl. No.: 18/887,430

(22) Filed: Sep. 17, 2024

(51) Int. Cl.
*B65H 19/12* (2006.01)
*B65H 16/10* (2006.01)

(52) U.S. Cl.
CPC ..... *B65H 19/126* (2013.01); *B65H 16/106* (2013.01); *B65H 2301/4175* (2013.01)

(58) Field of Classification Search
CPC .... B65H 19/10; B65H 19/126; B65H 16/106; B65H 2301/4175; B65H 16/06
See application file for complete search history.

(56) References Cited

U.S. PATENT DOCUMENTS 1,339,460 A * 5/1920 Langston ..... B65H 19/126 242/598.3
2,082,373 A * 6/1937 Wise Wood ..... B65H 19/126 242/555.3
3,329,369 A * 7/1967 Guthrie ..... B65H 19/126 242/559.3
5,333,803 A * 8/1994 Planeta ..... B65H 19/1894 242/555.3
5,344,089 A * 9/1994 Crowley ..... B65H 26/025 242/417
5,607,120 A * 3/1997 Folsom ..... B65H 16/106 242/559.4
2003/0089816 A1* 5/2003 Hanson ..... B65H 19/1889 242/559
2004/0118964 A1* 6/2004 Long ..... B65H 19/126 242/555.3
2014/0326822 A1* 11/2014 Morelli ..... B65H 16/106 242/555.3
2022/0289508 A1* 9/2022 Tsai ..... B65H 19/2238
2024/0051779 A1* 2/2024 Peutl ..... B65H 19/30

* cited by examiner

*Primary Examiner* — William A. Rivera
(74) *Attorney, Agent, or Firm* — HOVEY WILLIAMS LLP

(57) ABSTRACT

A supply roll stand for loading first and second supply rolls each including a core and dispensing material therefrom. The supply roll stand broadly comprises a frame, a lift support, an unwind assembly, and a transfer support. The lift support receives the first supply roll and raises the first supply roll. The unwind assembly unwinds the first supply roll as the lift support raises the first supply roll. The transfer support receives the first supply roll so that the first supply roll is transferred from the lift support. The lift support receives the second supply roll after the first supply roll is transferred to the transfer support. The transfer support dispatches the core of the first supply roll when the first supply roll is depleted of material. The unwind assembly unwinds the second supply roll when the first supply roll is depleted of material.

20 Claims, 7 Drawing Sheets

SUPPLY ROLL STAND WITH PAYOUT AND ROLL CHANGING

BACKGROUND

Production lines for stamping, forming, printing, and other manufacturing processes often require material to be paid out from a supply roll loaded onto a supply roll stand. Once the supply roll is depleted of material, a core of the supply roll is removed from the supply roll stand and a new supply roll is then loaded onto the supply roll stand, which includes feeding the material to a forming station or other production component. This changeover introduces substantial loss of production time.

The background discussion is intended to provide information related to the present invention which is not necessarily prior art.

SUMMARY

The present invention solves the above-described problems and other problems by providing a supply roll stand that minimizes loss of production time for loading supply rolls. More specifically, the present invention provides a supply roll stand that receives a supply roll as material is being metered from another supply roll.

A supply roll stand for loading first and second supply rolls each including a core and dispensing material from the first and second supply rolls according to an embodiment of the present invention broadly comprises a frame, a lift support, an unwind assembly, and a transfer support. The frame includes a left member and a transfer member. The lift support is configured to receive the first supply roll and move along the lift member to raise the first supply roll. The unwind assembly is configured to unwind the first supply roll as the lift support raises the first supply roll. The transfer support is suspended from the transfer member and configured to receive the first supply roll so that the first supply roll is transferred from the lift support. The lift support is configured to receive the second supply roll after the first supply roll is transferred to the transfer support. The transfer support is further configured to move along the transfer member for dispatching the core of the first supply roll when the first supply roll is depleted of material. The unwind assembly is further configured to unwind the second supply roll when the first supply roll is depleted of material.

A method of loading first and second supply rolls each including a core and dispensing material from the first and second supply rolls according to another embodiment of the invention broadly comprises steps of receiving the first supply roll via a lift support and moving the lift support to raise the first supply roll. The method further comprises a step of unwinding the first supply roll via an unwind assembly as the lift support raises the first supply roll. The method further comprises a step of receiving the first supply roll via a transfer support so that the first supply roll is transferred from the lift support. The method further comprises steps of receiving the second supply roll via the lift support, moving the core of the first supply roll when the first supply roll is depleted of material, and unwinding the second supply roll via the unwind assembly when the first supply roll is depleted of material.

A supply roll stand for loading first and second supply rolls each including a core and dispensing material from the first and second supply rolls according to another embodiment of the present invention broadly comprises a frame, an L-shaped lift support, a lift actuator, an unwind assembly, a J-shaped transfer support, and a transfer actuator. The frame includes a diagonally oriented lift member including a first slot and a horizontally oriented transfer member including a second slot. The L-shaped lift support is positioned in the first slot and configured to receive the first supply roll and move along the lift member to raise the first supply roll. The lift actuator is configured to drive the first roll support along the lift member. The unwind assembly is pivotably connected to the frame and configured to unwind the first supply roll as the lift support raises the first supply roll. The unwind assembly includes a roller configured to engage the first and second supply rolls and an unwind actuator configured to drive the roller. The J-shaped transfer support is suspended from the transfer member in the second slot and configured to receive the first supply roll so that the first supply roll is transferred from the lift support. The transfer actuator is configured to drive the transfer support along the transfer member. The lift support is configured to receive the second supply roll after the first supply roll is transferred to the transfer support. The transfer support is further configured to move along the transfer member for dispatching the core of the first supply roll when the first supply roll is depleted of material. The unwind assembly is further configured to unwind the second supply roll when the first supply roll is depleted of material.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWINGS

Embodiments of the present invention are described in detail below with reference to the attached drawing figures, wherein.

Figure 1:
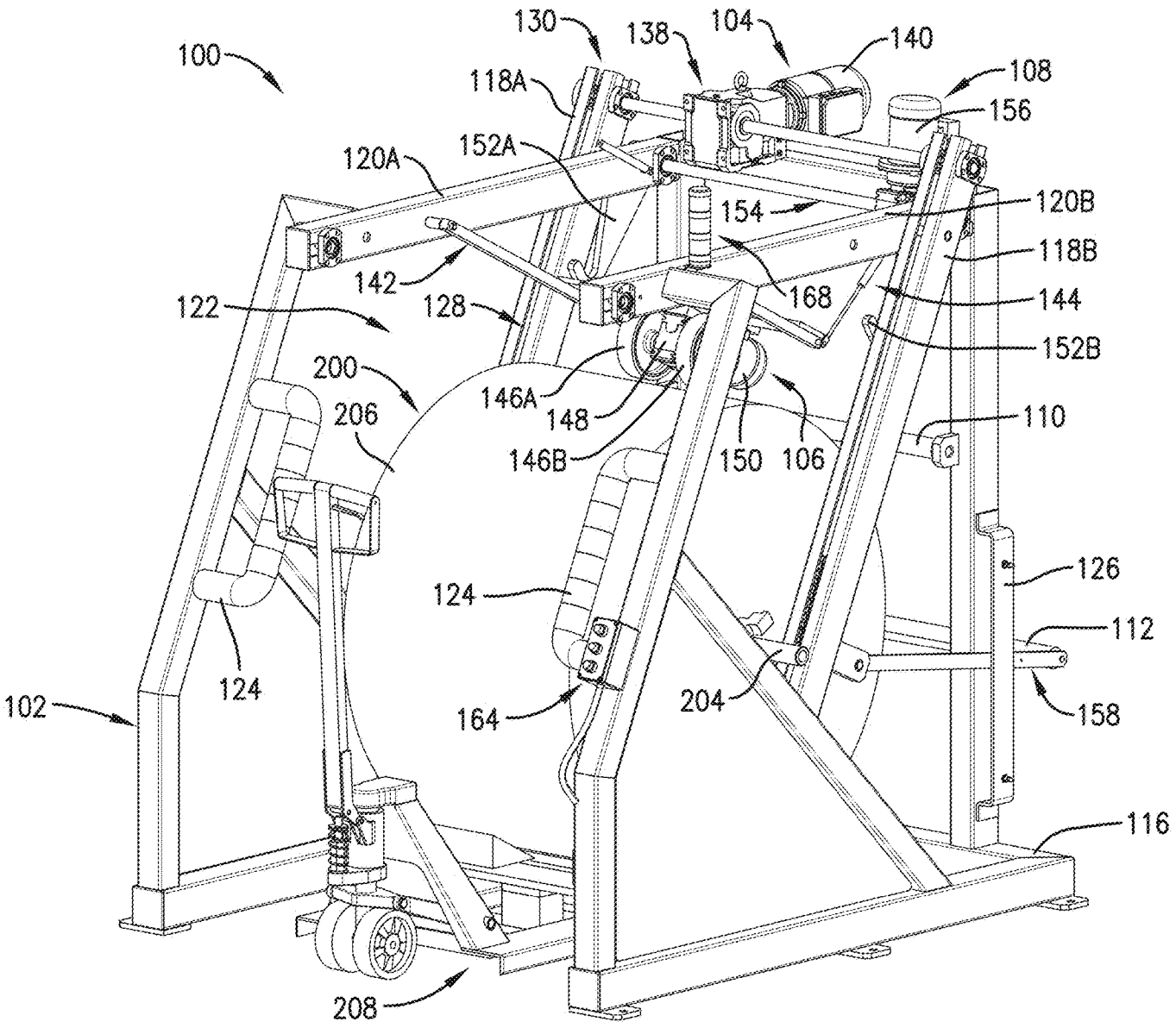
FIG. 1 is a perspective view of a supply roll stand constructed in accordance with an embodiment of the invention.
Figure 2:
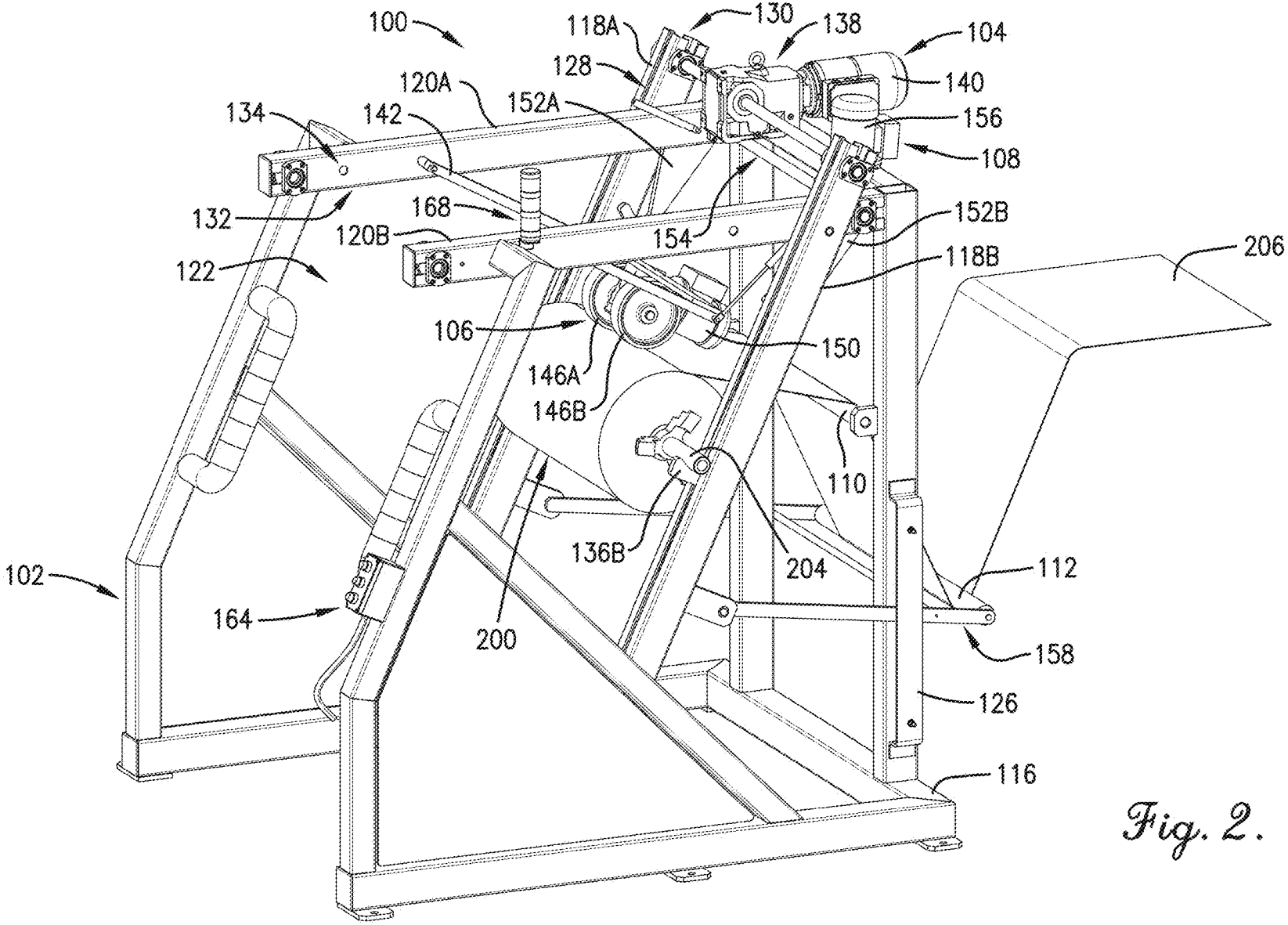
FIG. 2 is a perspective view of the supply roll stand of FIG. 1.
Figure 3:
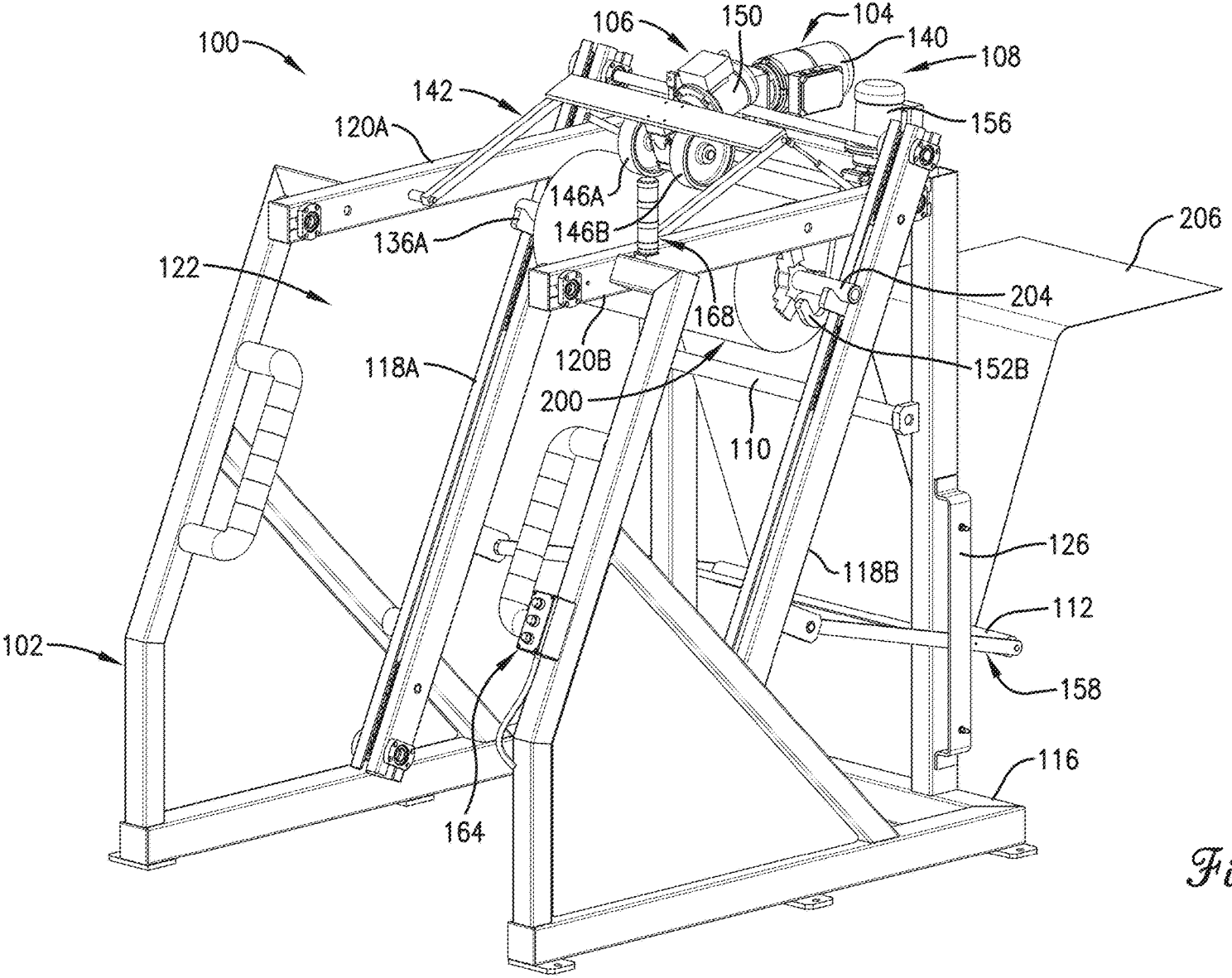
FIG. 3 is a perspective view of the supply roll stand of FIG. 1.
Figure 4:
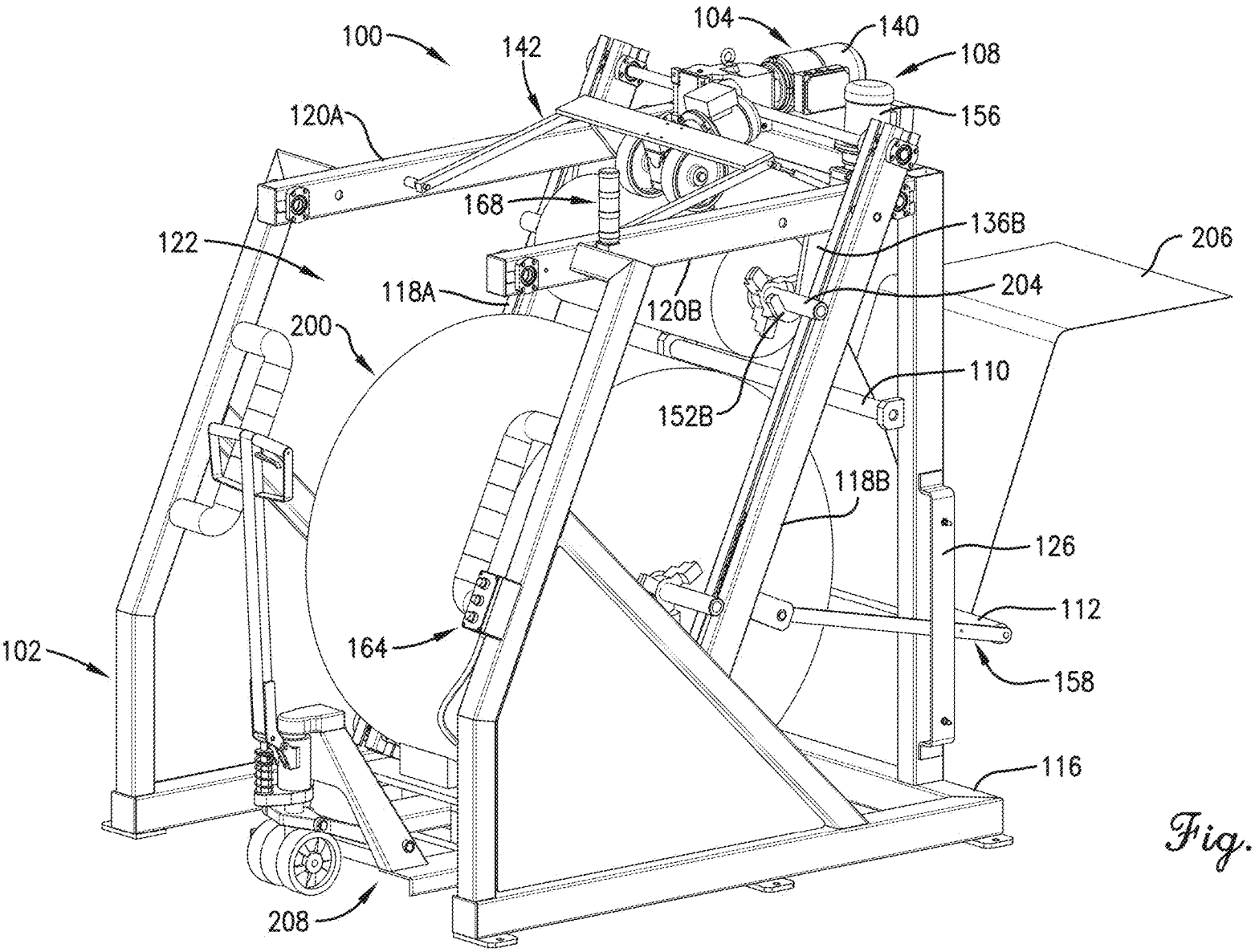
FIG. 4 is a perspective view of the supply roll stand of FIG. 1.
Figure 5:
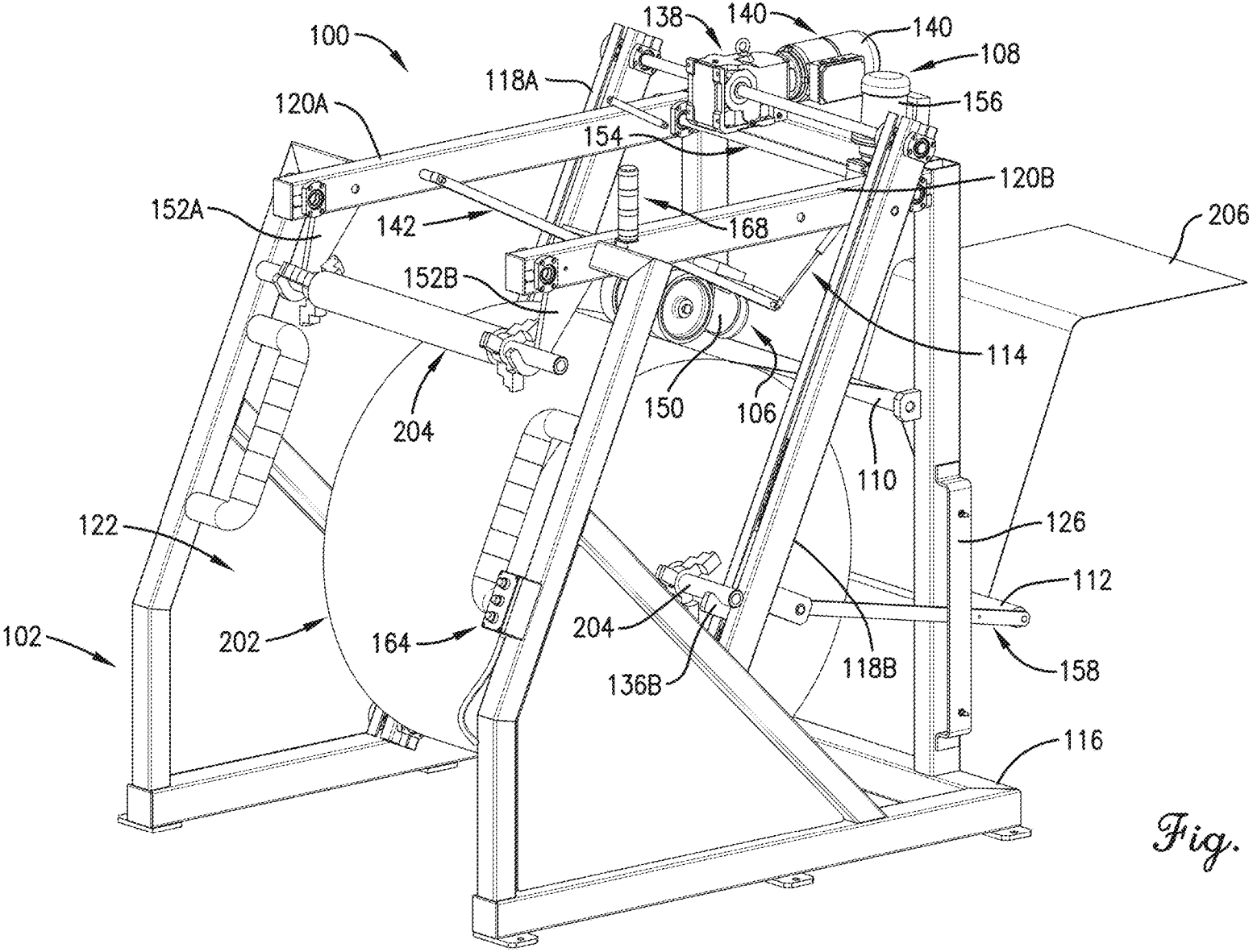
FIG. 5 is a perspective view of the supply roll stand of FIG. 1.

The drawing figures do not limit the present invention to the specific embodiments disclosed and described herein. The drawings are not necessarily to scale, emphasis instead being placed upon clearly illustrating the principles of the invention.

DETAILED DESCRIPTION

Turning to FIGS. 1-5, a supply roll stand 100 constructed in accordance with an embodiment of the present invention comprises a frame 102, a lift assembly 104, an unwind assembly 106, a transfer assembly 108, first and second guide rollers 110, 112, and a control system 114.

The frame 102 may include a base 116, left and right lift members 118A,B, left and right transfer members 120A,B. The frame 102 may form a supply roll bay 122 for receiving supply rolls 200, 202. The frame 102 may also include railings 124 for providing additional safety or support to an operator.

The left and right lift members 118A,B may be substantially similar so only left lift member 118A will be described in more detail. The left lift member 118A may be an elongated tubular structure including a slot 128 for receiving a left lift support (described below). The left lift member 118A may also have an internal channel 130 for housing components of the lift assembly 104. In one embodiment, the left lift member 118A may be oriented diagonally.

The left and right transfer members 120A,B may be substantially similar so only left transfer member 120 will be described in more detail. The left transfer member 120 may be an elongated tubular structure including a slot 132 for receiving a left transfer support (described below). The left transfer member 120 may also have an internal channel 134 for housing components of the transfer assembly 108. In one embodiment, the left transfer member 120 may be horizontally extending.

The lift assembly 104 lifts the supply rolls 200, 202 into an unwinding position and further lifts the supply rolls 200, 202 as they are being unwound. The lift assembly 104 may include left and right lift supports 136A,B, a lift drive train 138, and a lift actuator 140.

The left and right lift supports 136A,B may be substantially similar so only the left lift support 136A will be described in more detail. The left lift support 136A may be L-shaped and may be positioned in the slot 128. The left lift support 136A may be raised and lowered by the lift actuator 140 via the lift drive train 138.

The lift drive train 138 drivably connects the left and right lift supports 136A,B to the lift actuator 140 and may include gears, sprockets, chains, pulleys, sheaves, belts, axles, hydraulics, pneumatics, and the like.

The lift actuator 140 raises and lowers the left and right lift supports 136A,B via the lift drive train 138 according to control signals from the control system 114. To that end, the lift actuator 140 may be drivably connected to the left and right lift supports 136A,B via the lift drive train 138 and communicatively connected to the control system 114. The lift actuator 140 may be an electric motor, an electric servo, or the like.

The unwind assembly 106 unwinds material 206 from the supply rolls 200, 202 and may include a carriage 142, a suspension 144, rollers 146, a transmission 148, and an unwind actuator 150.

The carriage 142 provides a movable structure for mounting the rollers 146, transmission 148, and unwind actuator 150 thereto. The carriage 142 may be pivotably connected to the frame 102 (in one embodiment, to the left and right transfer members 120A,B). Alternatively, the carriage 142 may translate relative to the frame 102 or move in a complex motion involving rotation and translation.

The suspension 144 may provide additional support to the carriage 142, shock absorption, or damping. The suspension 144 may also bias the carriage 142 (and hence the rollers 146 toward or away from the supply rolls 200, 202 as needed.

The rollers 146 contact the material 206 and rotate the supply rolls 200, 202 so that the material 206 is advanced off the supply rolls 200, 202. To that end, the rollers 146 may be driven by the unwind actuator 150 via the transmission 148 and may include or be formed of a material that frictionally engages the material 206.

The transmission 148 drivably connects the rollers 146 to the unwind actuator 150. The transmission 148 may include gears, sprockets, chains, pulleys, sheaves, belts, axles, hydraulics, pneumatics, and the like.

The unwind actuator 150 drives the rollers 146 via the transmission 148 according to control signals from the control system 114. To that end, the unwind actuator 150 may be drivably connected to the rollers 146 via the transmission 148 and communicatively connected to the control system 114. The unwind actuator 150 may be an electric motor, an electric servo, or the like.

The transfer assembly 108 transfers cores 204 of the supply rolls 200, 202 to a remove position and may include left and right transfer supports 152A,B, a transfer drive train 154, and a transfer actuator 156.

The left and right transfer supports 152A,B may be substantially similar so only the left transfer support 152 will be described in more detail. The left transfer support 152 may be J-shaped and may be positioned in the slot 132. The left transfer support 152 may be moved forward and aft by the transfer actuator 156 via the transfer drive train 154.

The transfer drive train 154 drivably connects the left and right transfer supports 152A,B to the transfer actuator 156 and may include gears, sprockets, chains, pulleys, sheaves, belts, axles, hydraulics, pneumatics, and the like.

The transfer actuator 156 moves the left and right transfer supports 152A,B fore and aft via the transfer drive train 154 according to control signals from the control system 114. To that end, the transfer actuator 156 may be drivably connected to the left and right transfer supports 152A,B via the transfer drive train 154 and communicatively connected to the control system 114. The transfer actuator 156 may be an electric motor, an electric servo, or the like.

The first guide roller 110 may be rotatably mounted to the frame 102 such that material being metered from unwinding supply roll is directed over the first guide roller 110. The second guide roller 112 may be rotatably mounted on a carriage 158 such that material directed over the first guide roller 110 then passes under the second guide roller 112. The carriage 158 may be pivotably mounted to the frame 102 and bracketed by carriage guides 126 mounted on the frame 102 so that the second guide roller 112 takes up slack in the material as it passes to subsequent production stations.

Figure 6:
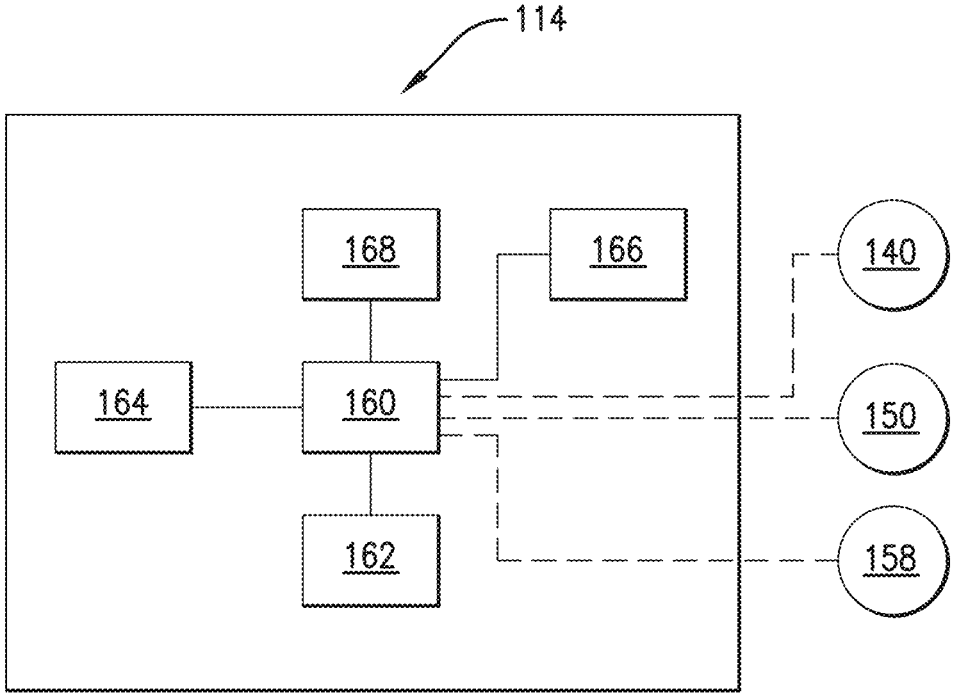
FIG. 6 is a schematic diagram of a control system of the supply roll stand of FIG. 1.

Turning to FIG. 6, the control system 114 may control the lift actuator 140, the unwind actuator 150, and the transfer actuator 156 and may include a controller 160, a memory 162, an input 164, a sensor 166, and indicator 168. The controller 160 may include electronic components such as microprocessors (single-core or multi-core), microcontrollers, digital signal processors (DSPs), field-programmable gate arrays (FPGAs), analog and/or digital application-specific integrated circuits (ASICs), or the like, or combinations thereof. The controller 160 may generally execute, process, or run instructions, code, code segments, code statements, software, firmware, programs, applications, apps, processes, services, daemons, or the like. The controller 160 may also include hardware components such as registers, finite-state machines, sequential and combinational logic, configurable logic blocks, and other electronic circuits that can perform the functions necessary for the operation of the current invention. In certain embodiments, the controller 160 may include multiple computational components and functional blocks that are packaged separately but function as a single unit. The controller 160 may be in electronic communication with the other electronic components through serial or parallel links that include universal busses, address busses, data busses, control lines, and the like.

The memory 162 may be embodied by devices or components that store data in general, and digital or binary data in particular, and may include exemplary electronic hardware data storage devices or components such as read-only memory (ROM), programmable ROM, erasable programmable ROM, random-access memory (RAM) such as static RAM (SRAM) or dynamic RAM (DRAM), cache memory, hard disks, floppy disks, optical disks, flash memory, thumb drives, universal serial bus (USB) drives, or the like, or combinations thereof. The memory 162 may include, or may constitute, a non-transitory "computer-readable medium". The memory 162 may store the instructions, code, code statements, code segments, software, firmware, programs, applications, apps, services, daemons, or the like that are executed by the controller. The memory 162 may also store data that is received by the controller 160. The memory 162 may further store data or intermediate results generated during processing, calculations, and/or computations. In addition, the memory 162 may store settings, data, documents, sound files, photographs, movies, images, databases, and the like.

The input 164 may be engaged by an operator for initiating various unwinding or loading steps or actions associated therewith as described below. The input 164 may include buttons, switches, knobs, dials, levers, sliders, graphical user interfaces, human machine interfaces (HMI), and the like.

The sensor 166 may provide a signal indicating the lift supports 136A,B have raised the loaded supply roll to a position for initiating unwinding. The sensor 166 may also provide a signal that corresponds to a roll diameter of the supply roll being unwound. The sensor 166 may be a rotary encoder, a proximity sensor, an optical sensor, or the like. In one embodiment, the sensor 166 may be a rotary encoder attached to or in communication with the carriage 142 of the unwind assembly 106.

The indicator 168 may be configured to alert an operator as to statuses, actions, phases, and the like of the supply roll stand 100. The indicator 168 may also provide warnings, notifications, instructions, recommendations, data or information readouts, and the like. The indicator 168 may include colored lights (e.g., red, green, yellow), a display screen, a speaker configured to provide aural output, and the like or any combination thereof.

Figure 7:
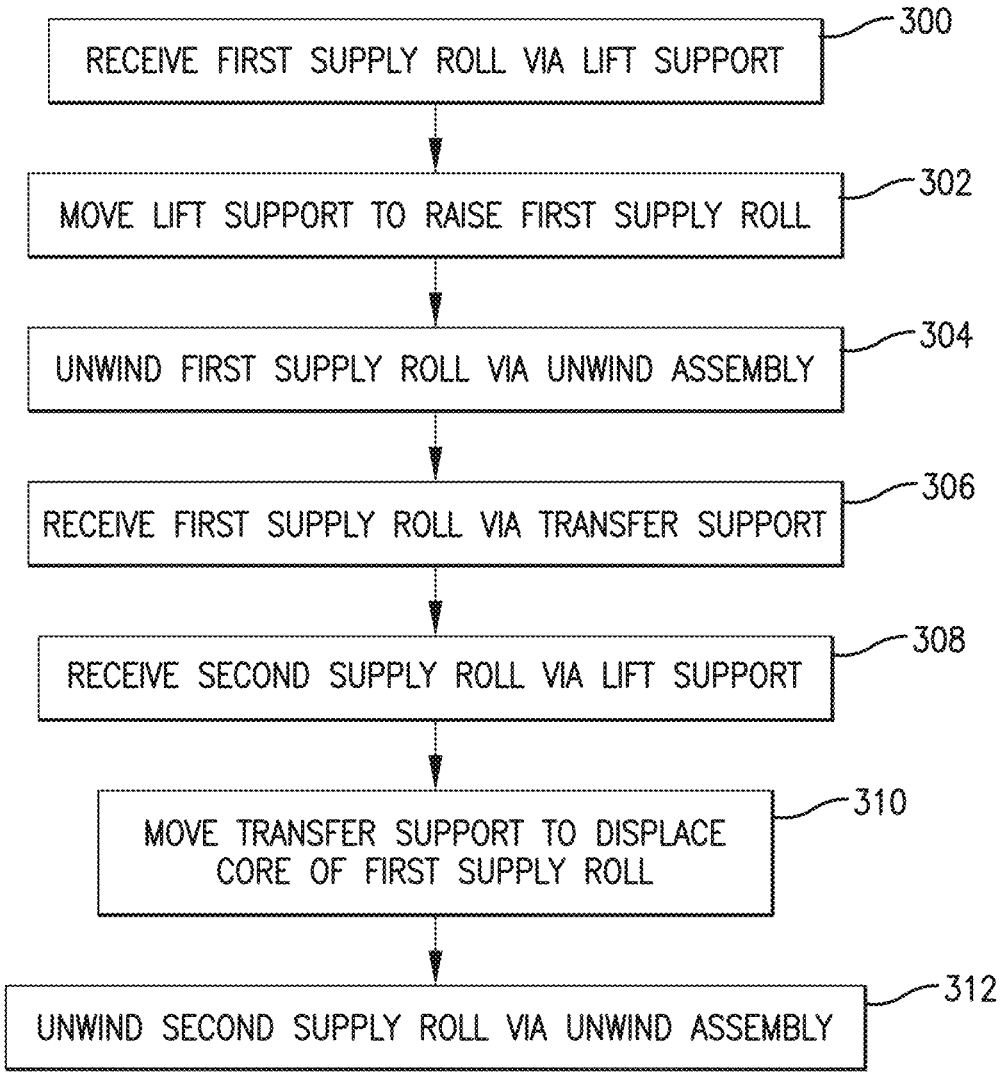
FIG. 7 is a flow diagram of certain method steps in accordance with another embodiment of the invention.

Turning to FIG. 7 and with reference to FIGS. 1-6, use of the supply roll stand 100 will now be described in more detail. First, the lift supports 136A,B may receive the first supply roll 200, as shown in block 300. To that end, the first supply roll 200 may be positioned in the supply roll bay 122 via a pallet jack, fork truck, or the like. The first supply roll 200 may be pushed until the core 204 of the first supply roll 200 contacts the lift members 118.

The lift supports 136A,B may then be moved to raise the first supply roll 200, as shown in block 302. To that end, the controller 160 may instruct the lift actuator 140 to drive the lift supports 136A,B upward along the lift members 118. The lift supports 136A,B may be driven upward until the rollers 146 are contacted or moved upward as detected by the sensor 166.

The first supply roll 200 may then be unwound via the unwind assembly 106, as shown in block 304. Specifically, the controller 160 may instruct the unwind actuator 150 to drive the rollers 146 so that material 206 is metered out from the first supply roll 200. The first supply roll 200 may be lifted slowly as its diameter decreases.

When the diameter of the first supply roll 200 has decreased to a predetermined value, such as 400 mm, as determined by the sensor 166, the second supply roll 202 may be loaded onto the supply roll stand 100. An operator may be alerted to this state by a yellow light of the indicator 168 flashing, for example. To initiate loading of the second supply roll 202, the operator may activate the input 164 (e.g., press a button) so that the controller 160 instructs the lift actuator 140 to drive the lift supports 136A,B upward to raise the first supply roll 200 further (e.g., to a top position). The unwind assembly 106 may pivot to accommodate this motion. The controller 160 may then instruct the transfer actuator 156 to move the transfer supports 152A,B along the transfer members 120 toward the first supply roll 200. The controller 160 may then instruct the lift actuator 140 to move the lift supports 136A,B downward along the lift members 118 so that the transfer supports 152A,B receive the first supply roll 200, as shown in block 306. The lift supports 136A,B may continue to move downward for receiving the second supply roll 202.

The lift supports 136A,B may then receive the second supply roll 202 while the unwind assembly 106 continues to meter out material 206 from the first supply roll 200, as shown in block 380. To that end, the second supply roll 202 may be positioned in the supply roll bay 122 via a pallet jack, fork truck, or the like. The second supply roll 202 may be pushed until the core 204 of the second supply roll 202 contacts the lift members 118.

The unwind assembly 106 may unwind the first supply roll 200 until it is depleted of material 206. The controller 160 may then instruct the transfer actuator 156 to drive the transfer supports 152A,B along the transfer members 120A,B such that the core 204 of the first supply roll 200 is displaced toward a front of the supply roll stand 100 for removal, as shown in block 310. The unwind assembly 106 may automatically drop onto the second supply roll 202.

The unwind assembly 106 may then unwind the second supply roll 202, as shown in block 312. As with the first supply roll 200, the lift supports 136A,B may slowly lift the second supply roll 202 as the second supply roll 202 is being unwound.

The above-described supply roll stand 100 and method provide several advantages. For example, loss of production time due to loading supply rolls is minimized or virtually eliminated because one supply roll can continue being unwound while another supply roll is being loaded. Supply rolls may be loaded from a low position and cores of unwound supply rolls may be displaced at a higher position, which minimizes risk of injury, wear and tear on loading equipment. Loading supply rolls is also simplified, which minimizes risk of incorrect loading.

Although the invention has been described with reference to example embodiments illustrated in the attached drawing figures, it is noted that equivalents may be employed and substitutions made herein without departing from the scope of the invention as described and claimed herein.

ADDITIONAL CONSIDERATIONS

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the current technology can include a variety of combinations and/or integrations of the embodiments described herein.

Although the present application sets forth a detailed description of numerous different embodiments, it should be understood that the legal scope of the description is defined by the words of the claims set forth in any subsequent regular utility patent application. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

The patent claims at the end of this patent application are not intended to be construed under 35 U.S.C. § 112(f) unless traditional means-plus-function language is expressly recited, such as "means for" or "step for" language being explicitly recited in the claim (s).

Although the invention has been described with reference to the embodiments illustrated in the attached drawing figures, it is noted that equivalents may be employed and substitutions made herein without departing from the scope of the invention as recited in the claims.

The invention claimed is:

1. A supply roll stand for loading first and second supply rolls each including a core and dispensing material from the first and second supply rolls, the supply roll stand comprising:

a frame including:
a lift member and
a transfer member;

a lift support configured to receive the first supply roll and move along the lift member to raise the first supply roll;

an unwind assembly configured to unwind the first supply roll as the lift support raises the first supply roll; and a transfer support suspended from the transfer member and configured to receive the first supply roll so that the first supply roll is transferred from the lift support;

the lift support being configured to receive the second supply roll after the first supply roll is transferred to the transfer support, the transfer support being further configured to move along the transfer member for dispatching the core of the first supply roll when the first supply roll is depleted of material, the unwind assembly being further configured to unwind the second supply roll when the first supply roll is depleted of material.

2. The supply roll stand of claim 1, wherein the lift support is L-shaped for engaging the cores of the first and second supply rolls.

3. The supply roll stand of claim 1, wherein the transfer support is J-shaped for engaging the cores of the first and second supply rolls.

4. The supply roll stand of claim 1, further comprising a lift actuator configured to drive the lift support along the lift member.

5. The supply roll stand of claim 1, further comprising a transfer actuator configured to drive the transfer support along the transfer member.

6. The supply roll stand of claim 1, wherein the unwind assembly is pivotably attached to the frame.

7. The supply roll stand of claim 1, wherein the unwind assembly includes a roller configured to engage the first and second supply rolls.

8. The supply roll stand of claim 7, wherein the unwind assembly includes an unwind actuator configured to drive the roller.

9. The supply roll stand of claim 1, wherein the lift member is oriented diagonally.

10. The supply roll of claim 1, wherein the lift member includes a slot configured to guide the lift support and the transfer member includes a slot configured to guide the transfer support.

11. A method of loading first and second supply rolls each including a core and dispensing material from the first and second supply rolls, the method comprising steps of:

receiving the first supply roll via a lift support;

moving the lift support to raise the first supply roll;

unwinding the first supply roll via an unwind assembly as the lift support raises the first supply roll;

receiving the first supply roll via a transfer support so that the first supply roll is transferred from the lift support;

receiving the second supply roll via the lift support;

moving the core of the first supply roll when the first supply roll is depleted of material; and unwinding the second supply roll via the unwind assembly when the first supply roll is depleted of material.

12. The method of claim 11, wherein the step of receiving the first supply roll via the lift support includes moving the lift support along a lift member.

13. The method of claim 12, wherein the step of moving the lift support includes driving the lift support along the lift member via a lift actuator.

14. The method of claim 11, further comprising a step of pushing the first supply roll until the first supply roll contacts the lift member before receiving the first supply roll.

15. The method of claim 11, wherein the step of receiving the first supply roll via the transfer support includes moving the transfer support along a transfer member.

16. The method of claim 15, wherein the step of moving the transfer support includes driving the transfer support along the transfer member via a transfer actuator.

17. The method of claim 11, wherein the unwinding steps include pivoting the unwind assembly relative to a frame to ensure a constant unwind speed.

18. The method of claim 11, the unwinding steps including engaging the supply rolls via a roller and driving the roller via an unwinding actuator.

19. The method of claim 11, wherein the step of moving the lift support includes moving the lift support diagonally.

20. A supply roll stand for loading first and second supply rolls each including a core and dispensing material from the first and second supply rolls, the supply roll stand comprising:

a frame including:
a diagonally oriented lift member including a first slot; and a horizontally oriented transfer member including a second slot;

an L-shaped lift support in the first slot and configured to receive the first supply roll and move along the lift member to raise the first supply roll;

a lift actuator configured to drive the first roll support along the lift member;

an unwind assembly pivotably connected to the frame, and configured to unwind the first supply roll as the lift support raises the first supply roll, the unwind assembly including:

a roller configured to engage the first and second supply rolls; and an unwind actuator configured to drive the roller; and a J-shaped transfer support suspended from the transfer member in the second slot and configured to receive the first supply roll so that the first supply roll is transferred from the lift support;

a transfer actuator configured to drive the transfer support along the transfer member;

the lift support being configured to receive the second supply roll after the first supply roll is transferred to the transfer support, the transfer support being further configured to move along the transfer member for dispatching the core of the first supply roll when the first supply roll is depleted of material, the unwind assembly being further configured to unwind the second supply roll when the first supply roll is depleted of material.

* * * * *